US007731561B2

(12) United States Patent
Chernick et al.

(10) Patent No.: US 7,731,561 B2
(45) Date of Patent: Jun. 8, 2010

(54) PLUSH CHARACTER HAVING SPINNING NOSE ELEMENTS

(76) Inventors: Mark J. Chernick, 19180 144th Ave., NE., Woodinville, WA (US) 98072; Webb T. Nelson, 19180 144th Ave., NE., Woodinville, WA (US) 98072

( * ) Notice: Subject to any disclaimer, the term of this patent is extended or adjusted under 35 U.S.C. 154(b) by 488 days.

(21) Appl. No.: 11/731,822

(22) Filed: Apr. 2, 2007

(65) Prior Publication Data

US 2008/0242191 A1 Oct. 2, 2008

(51) Int. Cl.
*A63H 3/02* (2006.01)
*A63H 3/36* (2006.01)

(52) U.S. Cl. ..... 446/369; 446/391; 446/72; 446/219

(58) Field of Classification Search ..... 446/297, 446/298, 303, 304, 330, 352, 353, 369–372, 446/391, 395, 71, 72, 175, 219
See application file for complete search history.

(56) References Cited

U.S. PATENT DOCUMENTS 4,582,499 A * 4/1986 Saigo et al. ..... 446/304
5,141,464 A * 8/1992 Stern et al. ..... 446/338
6,371,826 B1 * 4/2002 Pestonji ..... 446/337
6,530,816 B1 * 3/2003 Chiu ..... 446/217
6,789,911 B2 * 9/2004 Nelson et al. ..... 362/35
2006/0094327 A1 * 5/2006 Chernick et al. ..... 446/175

* cited by examiner

*Primary Examiner*—Kien T Nguyen
(74) *Attorney, Agent, or Firm*—LaMorte & Associates

(57) ABSTRACT

A plush toy that has a spinning nose construction. The plush toy includes a plush character form made of a sewn body shell that is filled with soft stuffing. The sewn body shell terminates along open seam edges in a head section. The open seam edges define an opening. A motor is positioned in the head section of the plush character form. The motor is positioned so that the shaft protrudes out of the head section through the opening. To prevent the motor from moving, the open seam edges of the sewn body shell are fastened directly to the motor. A nose structure is provided that is coupled to the motor. The nose structure includes a proboscis and a plurality of elongated elements that radially extend from the proboscis. An array of lights can be attached to at least one of the elongated elements.

18 Claims, 4 Drawing Sheets

PLUSH CHARACTER HAVING SPINNING NOSE ELEMENTS

BACKGROUND OF THE INVENTION

1. Field of the Invention

The present invention relates to novelty devices that have small electric motors that cause parts of the novelty device to spin, such as spinning toy wands and novelty fans.

2. Prior Art Statement

In the prior art, there are many different types of novelty devices that contain small electric motors that cause elements on the novelty device to spin when activated. For instance, there are ballerina dolls that spin on a platform when activated. There are toy airplanes and helicopters that have blades that spin when activated.

One particular type of novelty device that has a spinning element is the battery operated personal fan. There are many different types of personal fans that are used to create a forced breeze when activated. There are also many types of fans that have LED arrays on their blades. In this manner, a pattern of lights can be observed as the fan blade spins. Such prior art novelty fans are exemplified by co-pending U.S. patent application Ser. No. 10/944,646, entitled, Spring Supported Illuminated Novelty Device With Spinning Light Sources, which has the same inventors as this application.

The present invention is a new type of novelty device that contains spinning elements. In this invention, the spinning elements are incorporated into the face structure of a plush doll, therein producing a new type of plush doll. The details of the improved plush doll design are described and claimed below.

SUMMARY OF THE INVENTION

The present invention is a plush toy that has a spinning nose construction. The plush toy includes a plush character form made of a sewn body shell that is filled with soft stuffing. The plush character form has a head section that forms the head of the plush toy. Within the head section of the plush character is an opening. The sewn body shell has seam edges that encircle the opening. The open seam edges define an opening that leads into the head section.

A motor is provided that has a rotating shaft. The motor is positioned in the head section of the plush character form. The motor is positioned so that the shaft protrudes out of the head section through the opening. To prevent the motor from moving, the open seam edges of the sewn body shell are fastened directly to the motor.

A nose structure is provided that is coupled to the protruding end of the shaft. The nose structure rotates with the shaft when the motor is activated. The nose structure includes a proboscis and a plurality of elongated elements that radially extend from said proboscis. An array of lights can be attached to at least one of the elongated elements so that a spinning pattern of lights is created as the elongated elements spin.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention plush character assembly can be formed into most any character shape, such as a rag doll, teddy bear or the like, the present invention plush character assembly is particularly well suited for characters having either beaks or whiskers. Accordingly, two exemplary embodiments of the present invention plush character assembly are shown. In a first embodiment, the invention is embodied as a penguin having a rotating beak. In a second embodiment, the invention is embodied as a cat having rotating whiskers. The selected embodiments are intended to be merely exemplary and should not be considered a limitation. It will be understood that the present invention plush character assembly can be configured into many other character shapes, all of which are intended to be included within the scope of the appended claims.

Figure 1:
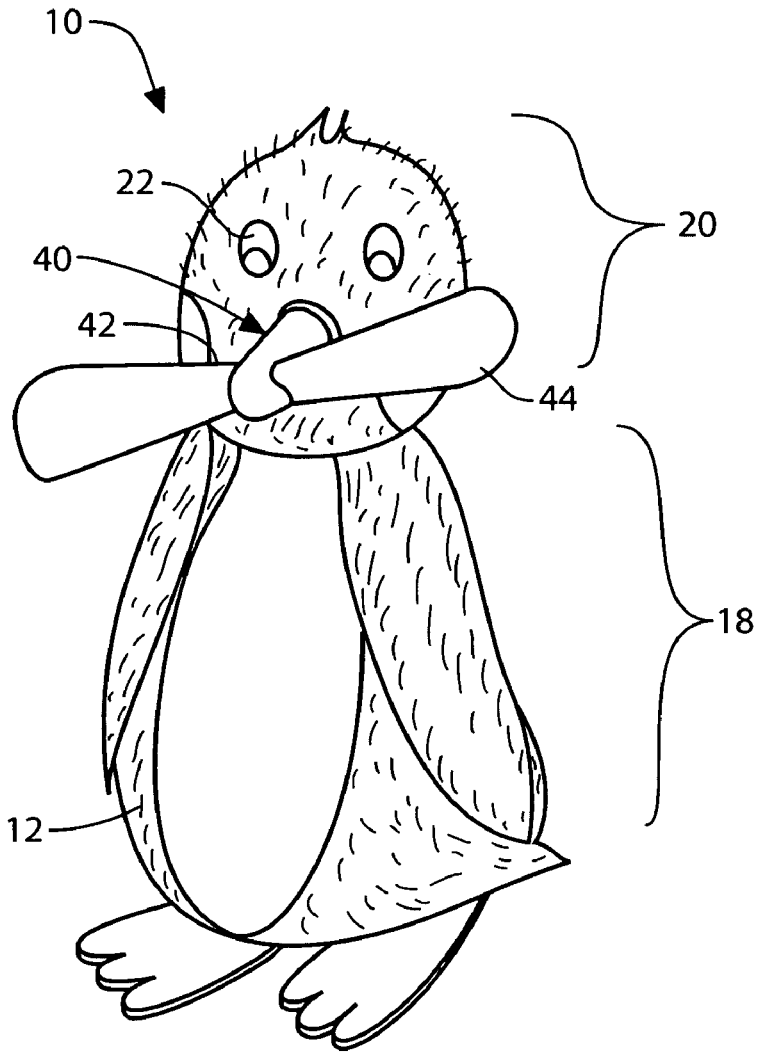
FIG. 1 is a perspective view of one exemplary embodiment of the present invention plush toy assembly.
Figure 2:
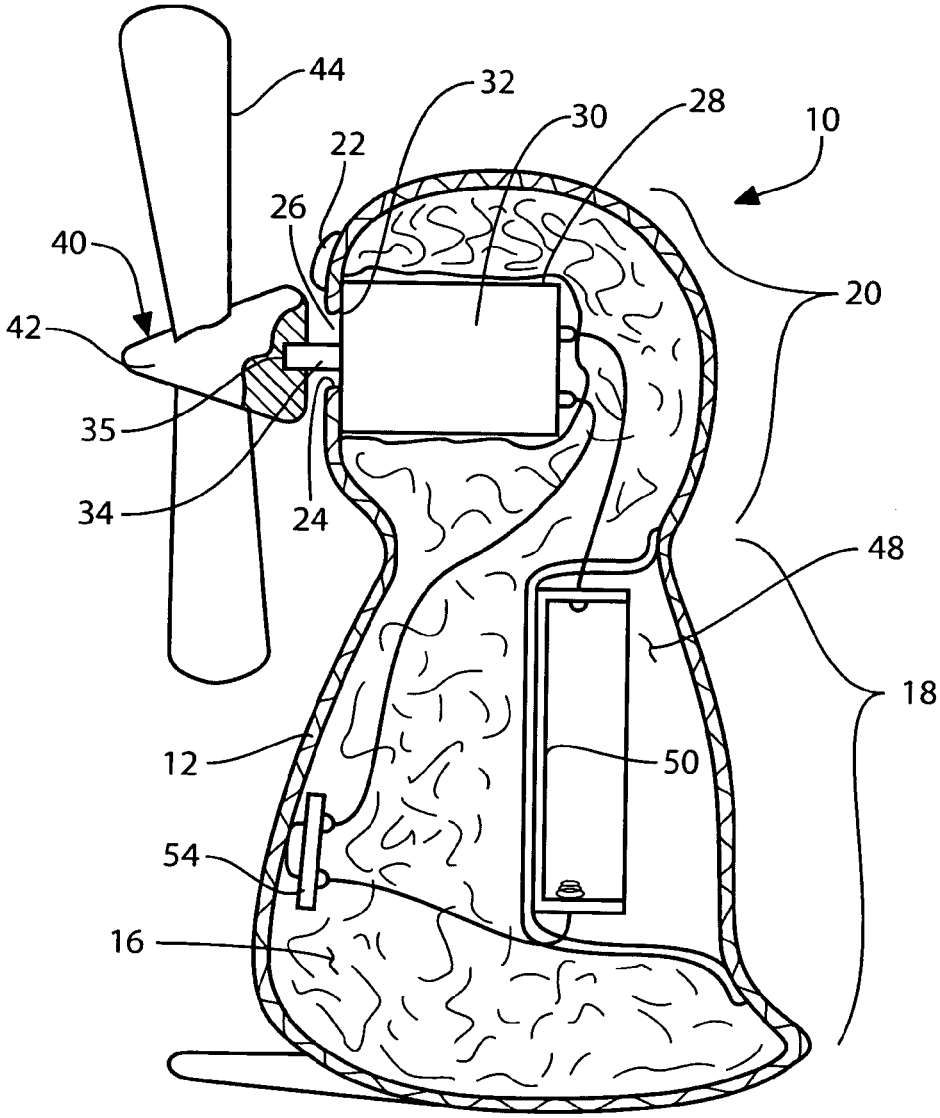
FIG. 2 is a selectively exploded and fragmented view of the embodiment of FIG. 1.

Referring now to both FIG. 1 and FIG. 2, an exemplary embodiment of the plush character assembly 10 is shown. The plush character assembly 10 has a sewn body shell 12. In the shown embodiment, the sewn body shell 12 is shaped as a penguin. The sewn body shell 12 is made in the traditional manner of plush toys. That is, the sewn body shell 12 contains material 14, such as synthetic fur, that is cut into a pattern and sewn together in the shape and color scheme of a selected character. The sewn body shell 12 is stuffed with traditional fill material 16, such as polypropylene fibers.

The sewn body shell 12 has a head section 20 and a torso section 18. The head section 20 forms the head of the plush character assembly 10 and therefore contains external facial features. The facial features include a set of eyes 22. The torso section 18 forms the body of the plush character and contains the limbs, fins, tail and/or other body features of the selected character type.

The head section 20 of the sewn body shell 12 is not fully formed. Rather, the head section 20 is truncated just beyond the eyes 22 of the plush character assembly 10. It will therefore be understood that the plush material 14 terminates as it intersects an imaginary vertical plane just in front of the plush character's eyes 22. As the plush material 14 terminates, it produces open seam edges 24. The open seam edges 24 define an opening 26 that leads into the head section 20 of the sewn body shell 12.

A first cavity 28 is formed in the head section 20 of the sewn body shell 12. The first cavity 28 is accessible through the opening 26 defined by the open seam edges 24 of the plush material 14. A motor 30 is provided that is sized to pass into the first cavity 28. The motor 30 is placed inside the first cavity 28. The motor 30 has a generally flat faceplate 32. The motor 30 is inserted into the first cavity 28 so that the faceplate 32 of the motor 30 is oriented in the same vertical plane as the open seam edges 24 of the plush material 14. The open seam edges 24 of the plush material 14 are adhered to the faceplate 32 of the motor 30. The adhesive used to attach the open seam edges 24 to the faceplate 32 binds the open seam edges 24, thereby preventing them from fraying. Furthermore, the adhesion of the open seam edges 24 to the faceplate 32 of the motor 30 prevents the motor 30 from shifting within the first cavity 28.

The motor 30 turns a shaft 34 when activated. The shaft 34 has a free end 35 that extends forward beyond the faceplate 32 of the motor 30. A nose structure 40 is attached to the free end 35 of the motor shaft 34. Accordingly, the nose structure 40 rotates with the shaft 34 when the motor 30 is activated. The nose structure 40 has two parts. Those parts include a proboscis 42 and elongated elements 44 that radially extend from the proboscis 42. The proboscis 42 can be a snout, beak, trunk or the like. In the illustrated embodiment, the sewn body shell 12 is configured as the body of a penguin. Accordingly, the proboscis 42 is shaped as a penguin's beak. It will be understood that the sewn body shell 12 and the proboscis 42 will have complementary forms to create a plush character assembly 10 of a recognizable type.

The elongated elements 44 radially extend from the proboscis 42. The elongated elements 44 can take several forms, as will be explained. In the shown embodiment, the elongated elements 44 take the shape of flexible fan blades 46. Consequently, when the fan blades 46 spin, the fan blades 46 move air and serve as an electric fan.

A second cavity 48 is formed in the torso section 18 of the sewn body shell 12. A battery receptacle 50 is placed inside the second cavity 48. The battery receptacle 50 is accessible through a closable access opening 52. Accordingly, the batteries 53 held by the battery receptacle 50 can be selectively replaced.

An activation switch 54 is also contained within the torso section 18 of the sewn body shell 12. The activation switch 54 selectively activates and deactivates the motor 30 by turning on and off the flow of electrical current to the motor 30. The activation switch 54 is preferably located in an appendage of the plush character assembly 10 so that it can be easily located and squeezed through the plush material 14.

Figure 3:
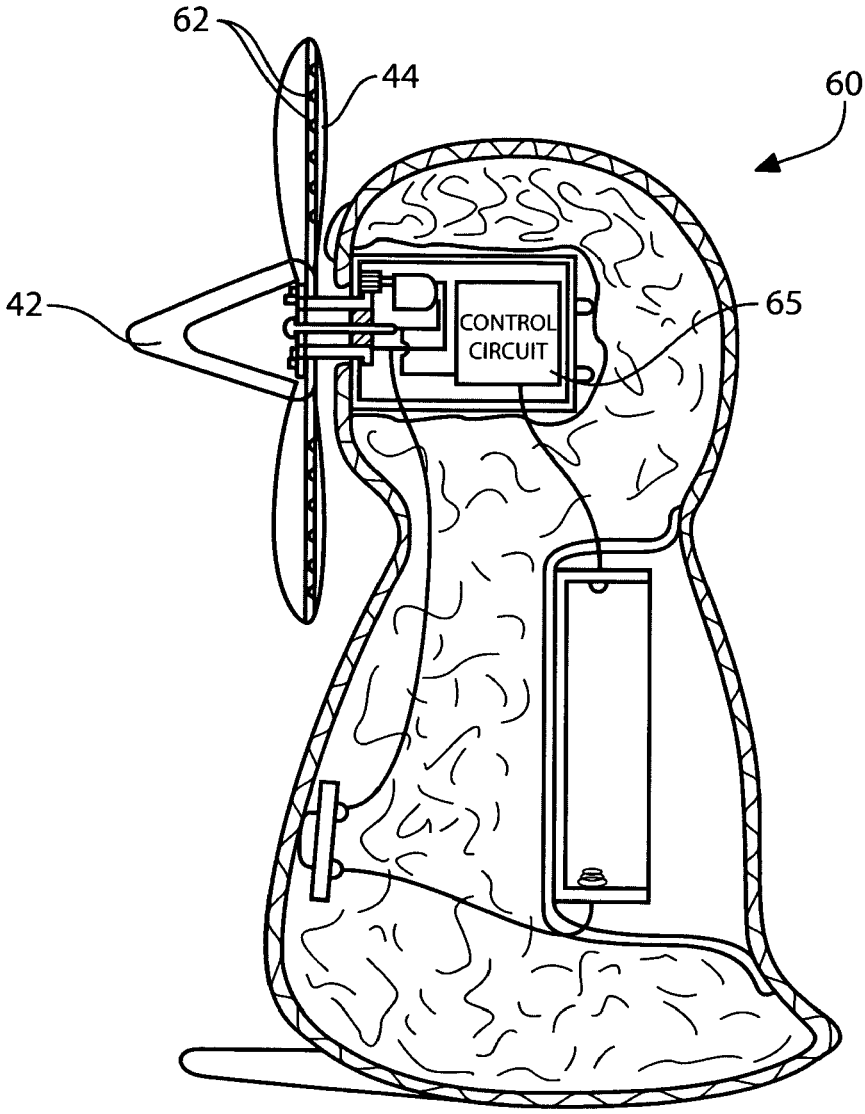
FIG. 3 is a front view of the head section of an alternate embodiment of the present invention plush toy assembly.

Referring to FIG. 3, a modification to the previous embodiment is shown. Since the alternate embodiment shares most of the features of the first illustrated embodiment, the same reference numbers will be used to identify identical parts.

In the alternate embodiment of a plush character assembly 60, an array of light sources, in the form of LEDs 62, are positioned along the elongated elements 44 that radially extends from the proboscis 42. The LEDs 62 light as the elongated elements 44 spin. The LEDs 62 can light in controlled patterns, thereby creating aesthetically pleasing rotating patterns of light. To light the LEDs 62 in a controlled pattern, a control circuit 65 is added. The control circuit 65 can be either inside the sewn body shell 12 or inside the nose structure 40. The structure needed to have LEDs light on spinning fan blades is disclosed in U.S. Pat. No. 7,179,149, entitled Spring Supported Illuminated Novelty Device With Spinning Light Sources, the disclosure of which is incorporated into this specification by reference.

Figure 4:
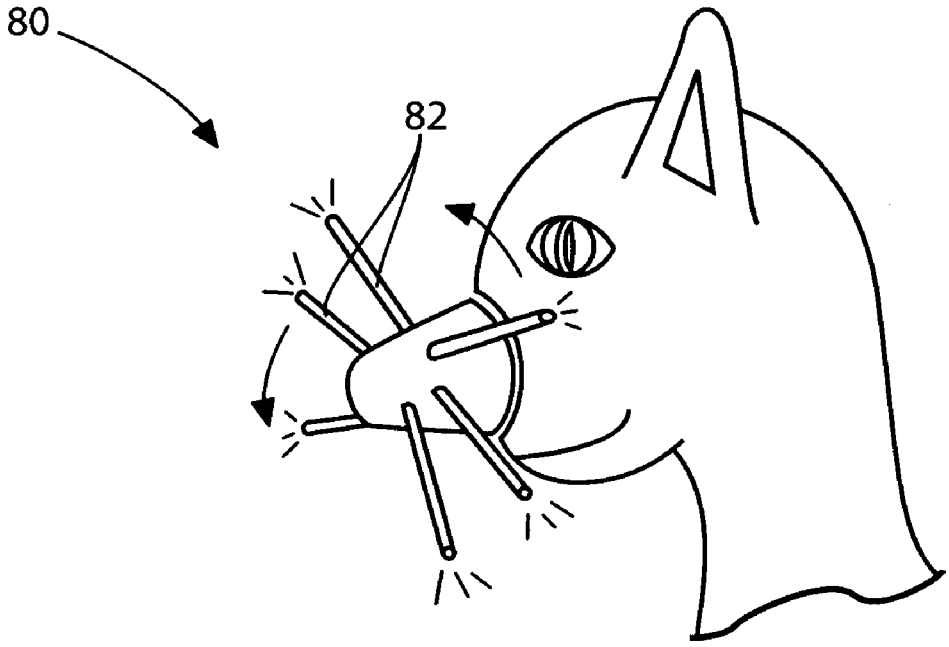
FIG. 4 is a perspective view of another alternate embodiment of the present invention plush toy assembly.

Referring to FIG. 4, another alternate embodiment of a plush character assembly 70 is shown. In this embodiment, the plush character assembly 70 is configured as a cat. As with the earlier embodiments, the cat has a sewn body shell 72 of plush material 74. However, the sewn body shell 72 is designed to present the appearance of a cat, rather than a penguin. A motor 76 is inserted into the head section 78 of the sewn body shell 72. A nose structure 80 is attached to the motor 76, whereby the nose structure 80 spins when the motor 76 is activated.

What is functionally different about the embodiment of FIG. 4, is that the nose structure 80 no longer has radially extending elements that are shaped as fan blades. Rather, the radially extending elements are fiber optic elements 82 that give the appearance of whiskers. The fiber optic elements 82 may emit light. As such, a pattern of light will be created as the fiber optic elements 82 spin. The technology needed to shine light patterns through spinning optical fibers is contained in co-pending patent application Ser. No. 10/916,132, entitled Spinning Fiber Optic Novelty Device And Its Associated Method Of Manufacture, filed Aug. 12, 2004, the disclosure of which is incorporated into this specification by reference.

It will be understood that the embodiments of the present invention specifically described and illustrated are merely exemplary and the shown embodiments can be modified in many ways. For example, the number of light sources, the number of radially extending elements and the position of the light sources on the radially extending elements can be varied in any manner by a person skilled in the art. Furthermore, the shape of the plush character, the radially extending elements, and the remaining nose structure can be varied. All such alternate embodiments and variations are intended to be included within the scope of the claims as listed below.

What is claimed is:

1. A toy plush character assembly, comprising:

a plush character form comprised of a sewn body shell filled with soft stuffing, said plush character form having a head section, wherein said sewn body shell terminates along open seam edges in said head section, wherein said open seam edges define an opening that leads into said head section;

a motor having a shaft extending therefrom that is rotated by said motor, said motor being positioned in said head section, wherein said shaft protrudes out of said head section through said opening, and wherein said open seam edges of said sewn body shell are fastened to said motor;

a nose structure coupled to said shaft outside of said head section, wherein said nose structure rotates with said shaft when said motor is activated;

a battery receptacle contained inside said sewn body shell for holding batteries used to power said motor; and an activation switch supported by said plush character form that selectively activates said motor.

2. The assembly according to claim 1, wherein said open seam edges are adhesively affixed to said motor.

3. The assembly according to claim 1, wherein said nose structure includes a proboscis and a plurality of elongated elements that radially extend from said proboscis.

4. The assembly according to claim 3, wherein said plurality of elongated elements are fan blades that move when rotated by said motor.

5. The assembly according to claim 3, further including a plurality of light sources supported by at least one of said elongated elements, wherein at least some of said plurality of light sources are positioned at different distances from said probiscus.

6. The assembly according to claim 5, further including a control circuit that selectively lights said plurality of light sources as they spin to produce a predetermined changing pattern of light.

7. The assembly according to claim 3, wherein said elongated elements are fiber optic elements.

8. The assembly according to claim 7, further including at least one light source for passing light through said fiber optic elements.

9. The assembly according to claim 1, wherein said sewn body shell is shaped as a specific type of animal and said proboscis is formed as the nose of said type of animal.

10. A plush toy assembly, comprising:

an array of light sources;

a motor having a shaft extending therefrom that is rotated by said motor; and a stuffed, plush character form having a head and a nose, wherein said motor is disposed in said head and said array of light sources extends from said nose, wherein said shaft joins said nose to said motor.

11. The assembly according to claim 10, wherein said plush character form is comprised of a sewn body shell filled with soft stuffing, wherein said sewn body shell terminates along open seam edges between said head and said nose.

12. The assembly according to claim 11, wherein said open seam edges of said sewn body shell are fastened to said motor.

13. The assembly according to claim 12, wherein said open seam edges are adhesively affixed to said motor.

14. The assembly according to claim 11, further including a battery receptacle contained inside said sewn body shell for holding batteries used to power said motor.

15. The assembly according to claim 10, further including an activation switch supported by said plush character form that selectively activates said motor.

16. The assembly according to claim 10, wherein said nose includes a proboscis and a plurality of elongated elements that radially extend from said proboscis, wherein said array of light sources are affixed to at least one of said elongated elements.

17. The assembly according to claim 16, wherein said plurality of elongated elements are fan blades that move when rotated by said motor.

18. The assembly according to claim 17, wherein said sewn body shell is shaped as a specific type of animal and said proboscis is formed as the nose of said type of animal.

* * * * *